United States Patent [19]

Sylvestre et al.

[11] 4,361,207

[45] Nov. 30, 1982

[54] APPARATUS AND METHOD FOR DRAINING ENGINE CRANKCASE

[76] Inventors: Roland Sylvestre, 7 Caribou Dr., Norwich, Conn. 06360; Vallier Paradis, P.O. Box 51, Baltic, Conn. 06330

[21] Appl. No.: 204,862

[22] Filed: Nov. 7, 1980

[51] Int. Cl.[3] ..... F01M 11/04

[52] U.S. Cl. ..... 184/1.5; 134/10; 134/18; 184/1 E

[58] Field of Search ..... 184/1.5, 1 E; 134/10, 134/18

[56] References Cited

U.S. PATENT DOCUMENTS

| | | | |
|---|---|---|---|
| 2,216,360 | 1/1937 | Sweetland | 184/1.5 |
| 3,112,012 | 3/1960 | Hoch | 184/1.5 |
| 3,447,636 | 6/1969 | Bonfilio | 184/1.5 |
| 3,743,053 | 7/1973 | Kuklewicz | 184/1.5 |
| 3,881,460 | 5/1975 | Allen et al. | 123/196 S |
| 3,908,797 | 9/1975 | Schnepp | 184/1.5 |
| 3,991,854 | 11/1976 | Tilley | 184/1.5 |
| 4,151,823 | 5/1979 | Grosse et al. | 123/196 A |
| 4,172,738 | 10/1979 | Woltjen | 184/1.5 X |
| 4,174,231 | 11/1979 | Hobgood | 134/10 |

FOREIGN PATENT DOCUMENTS

| | | | |
|---|---|---|---|
| 55-109714 | 2/1979 | Japan | 184/1.5 |
| 55-109715 | 2/1979 | Japan | 184/1.5 |

OTHER PUBLICATIONS

Popular Mechanics, Jun. 1975, p. 36.

*Primary Examiner*—David H. Brown
*Attorney, Agent, or Firm*—Bacon & Thomas

[57] ABSTRACT

Oil draining apparatus for an engine having a spin-on oil filter mounting pad, the apparatus comprising an adapter housing attachable to the pad, the housing having inlet and outlet openings for enabling oil to be pumped from the engine into the housing through the mounting pad oil outlet and drained out of the housing away from the engine while the engine is running. The housing is arranged to permit some oil to return to the engine while it is running until the oil is drained.

4 Claims, 3 Drawing Figures

APPARATUS AND METHOD FOR DRAINING ENGINE CRANKCASE

BACKGROUND OF THE INVENTION

This invention relates to apparatus for draining oil from the crankcase of an engine and a method for carrying out such a procedure.

The primary objective of the invention is to permit one to drain oil from the crankcase of an engine under conditions when the crankcase drainplug is not readily accessible. It is also intended by means of this invention to enable one to drain oil from the crankcase of an engine in a simple, efficient manner without removing the crankcase drainplug by using the oil pump of the engine itself.

Various proposals have been made in the prior art for draining oil from the crankcase of an engine without removing the crankcase drainplug. Some exemplary devices are illustrated in U.S. Pat. Nos. 2,216,360; 3,112,012; and 3,991,854. These patents disclose prior art systems utilizing the engine oil pump itself to drain the crankcase as well as external pumps that are connected to the crankcase by suitable conduits. However, the prior art patents do not specifically disclose an adapter directly connectable to a spin-on oil filter post of an engine that permits crankcase oil to be pumped from the engine by using the engine oil pump when the engine is operated and arranged to enable a portion of the pumped oil to be returned to the engine via the spin-on post mounting during the draining procedure.

SUMMARY OF THE INVENTION

The present invention comprises an adapter that can be secured to the spin-on oil filter mounting pad of an internal combustion engine, the adapter including a housing having an internal volume that can be placed in communication with the oil outlet and return ports located at the oil filter mounting pad of the engine. The housing is furthermore provided with an outlet port that can be connected to a drain hose whereby starting up and running of the engine will result in crankcase oil being pumped into the housing, with a portion of the oil being returned to the crankcase via the oil filter mounting post and the remaining portion of the oil discharged from the housing into a drain until all the oil is pumped out of the crankcase.

In accordance with the preferred embodiment of the invention, the outlet port from the adapter housing is smaller in cross section than the combined cross sectional area of the inlet port or ports into the housing, whereby the opportunity is provided for some of the oil to return to the engine while the draining procedure is being carried out. The reduced outlet volume also prevents full oil pump outlet volume from being discharged at high pressure from the drain outlet of the housing to minimize splashing of oil during the draining procedure and other handling problems.

The method of draining engine crankcase oil in accordance with the present invention comprises using the engine oil pump to pump the oil from the crankcase out through the oil outlet port provided on the mounting pad for a spin-on oil filter. The pumped oil is discharged into a housing having one or more inlet ports capable of passing all of the oil that is pumped from the engine into the housing, and a pair of outlet ports respectively connected to the oil return line corrected to the filter mounting post and a drain outlet, whereby the oil may be pumped from the engine into the housing while the engine is running and a portion of the oil may return to the engine while the remaining portion is drained away from the engine crankcase until all of the oil has been drained.

DESCRIPTION OF THE PREFERRED EMBODIMENT

Figure 1:
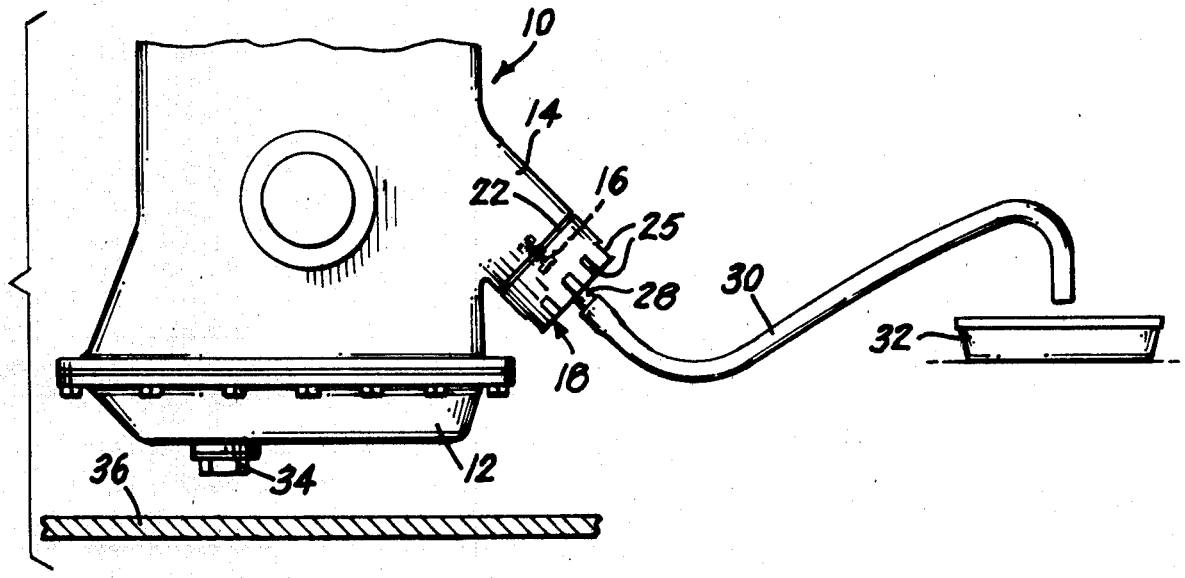
FIG. 1 is a fragmentary front elevational view of an engine with the adapter according to the present invention attached thereto.

With reference to FIG. 1, an internal combustion engine 10 includes a crankcase cover 12 and a spin-on filter mounting pad 14. Normally, a spin-on oil filter (not shown) is retained against the pad 14 by a threaded nipple 16.

Figure 2:
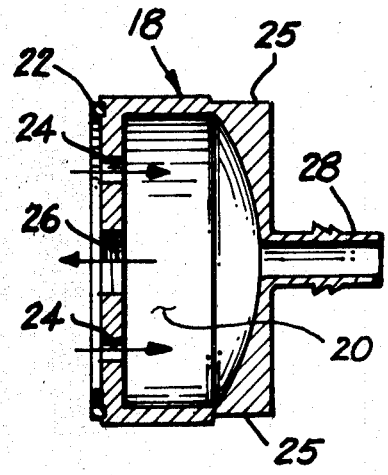
FIG. 2 is a cross sectional view of the adapter constructed in accordance with the present invention.
Figure 3:
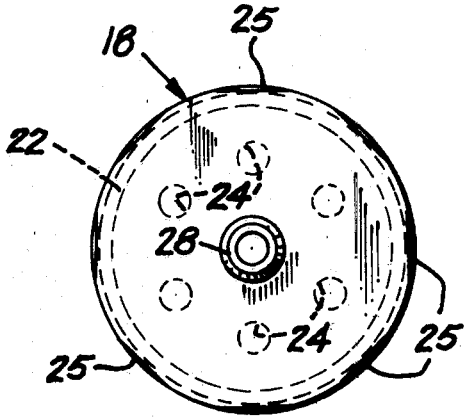
FIG. 3 is an end view of the adapter shown in FIG. 2.

The present invention comprises an adapter housing 18 (see also FIGS. 2 and 3) having an internal open volume 20 mounted on the threaded nipple 16 and sealed against the mounting pad 14 by means of a seal element 22. A plurality of inlet ports 24 are provided at one end of the housing 18 in communication with similar oil discharge or outlet ports (not shown) in the mounting pad 24. The outlet ports in the mounting pad discharge oil from the oil pump (not shown) in engine 10 which then flows through inlet ports 24 into the volume 20 within the housing 18. Suitable flats or indentations 25 may be provided to enable torque to be applied to the housing.

The housing 18 is also provided with a first outlet port 26 that communicates with the nipple 16 through which return oil to the engine flows when the oil pump is operating. The port 26 is threaded and is coupled to the nipple 16 during use.

The housing 18 is also provided with a second outlet port 28 through which crankcase oil is drained from the housing. As shown in FIG. 1, port 28 may be connected to a suitable hose 30 for permitting the drained oil to be discharged into a receptacle 32 for disposal or recycling. A valve (not shown) can be provided at or near the outlet port 28 to control discharge of oil from the housing.

This invention has particular application in situations where the oil drainplug 34 of the crankcase 12 is located in a position whereat it is difficult to remove same and catch the engine oil in a receptacle that normally would be placed beneath the plug. A situation such as this is not uncommon where marine engines are involved, for example, where such engines are placed close to the bottom of the boat or other structure as represented at 36.

In operation, the engine 10 is started and is permitted to run with the housing 18 mounted in place on the oil filter mounting pad. Oil is received into housing 18 through inlet ports 24 and part of the oil returns to the engine through the first outlet 26 while the remaining oil is discharged through the outlet port 28 until all the oil is drained.

The outlet 28 preferably is configured to be smaller in cross section generally than the total cross sectional area of the inlet ports 24 to reduce the volume flowing through the drain hose 30 to prevent splashing of oil in a receptacle and to permit easy handling of the discharged oil. Such a configuration furthermore enables a portion of the oil to be returned to the engine via the first outlet port 26 that is connected to the nipple 16 of the oil filter mounting pad. The engine is therefore able to receive oil under pressure for as long as possible while the draining is proceeding. In actuality, the typical engine can run at idle without oil in the crankcase for a limited period of time without damage, so that the draining procedure can be carried out safely to completion. It will readily be apparent to the individual carrying out the oil draining operation when the oil has been discharged from the outlet 28 of the housing 18 by visual observation, at which time the engine can be promptly shut off. Upon the conclusion of the draining operation, the housing 18 is removed from the oil filter mounting pads and a clean spin-oil filter is mounted in its normal place.

It will be apparent that the illustrated embodiment is but a single embodiment of the invention, which can be readily modified within the scope of the following claims without departing from the spirit of the invention.

What is claimed is:

1. Oil draining apparatus for an engine having a spin-on filter mounting pad including a mounting post constituting an oil return line, and an oil outlet port or ports, said apparatus comprising an adapter housing having an open internal volume, a threaded first outlet port at one end of said housing in communication with said volume and arranged to permit the housing to be mounted on the oil filter post of the engine, at least one inlet port in communication with said volume and arranged to communicate with the outlet port or ports at the mounting pad, when the housing is mounted on the pad, and a second outlet port in communication with said volume spaced away from said first outlet port.

2. Engine oil draining apparatus as claimed in claim 1, said second outlet port being located towards the end of the housing opposite said first outlet port.

3. Engine oil draining apparatus as claimed in claim 1 or 2, said second outlet port being smaller in cross sectional area than the total cross sectional area of said inlet port or ports.

4. A method of draining crankcase oil from an engine having an oil pump and a spin-oil filter mounting pad including oil outlet and return ports associated therewith, comprising:

(a) starting and running the engine;

(b) using the engine oil pump to pump oil from the crankcase out through the oil outlet port into an adapter housing mounted on the oil filter mounting pad;

(c) permitting a portion of the pumped oil to flow back to the engine from the housing through the return port, (d) draining a portion of pumped oil out of the housing away from the engine; and (e) stopping the engine when oil ceases to flow out from the housing.

* * * * *